US009826303B2

(12) United States Patent
Fukui

(10) Patent No.: US 9,826,303 B2
(45) Date of Patent: Nov. 21, 2017

(54) PORTABLE TERMINAL AND PORTABLE TERMINAL SYSTEM

(71) Applicant: KYOCERA Corporation, Kyoto-shi, Kyoto (JP)

(72) Inventor: Yujiro Fukui, Kawanishi (JP)

(73) Assignee: KYOCERA Corporation, Kyoto (JP)

( * ) Notice: Subject to any disclaimer, the term of this patent is extended or adjusted under 35 U.S.C. 154(b) by 48 days.

(21) Appl. No.: 14/695,346

(22) Filed: Apr. 24, 2015

(65) Prior Publication Data

US 2015/0312674 A1 Oct. 29, 2015

(30) Foreign Application Priority Data

Apr. 24, 2014 (JP) ..... 2014-090366

(51) Int. Cl.

| | |
|---|---|
| ***H04R 25/00*** | (2006.01) |
| ***H04R 1/10*** | (2006.01) |
| *H04R 17/00* | (2006.01) |
| *H04R 3/00* | (2006.01) |

(52) U.S. Cl.

CPC ..... *H04R 1/1083* (2013.01); *H04R 1/1041* (2013.01); *H04R 3/005* (2013.01); *H04R 17/00* (2013.01); *H04R 2420/01* (2013.01); *H04R 2460/13* (2013.01)

(58) Field of Classification Search

CPC .. H04R 1/1075; H04R 1/1008; H04R 1/1016; H04R 2499/11; H04R 25/558; H04R 3/005

USPC ..... 381/56, 119, 370, 373; 704/233

See application file for complete search history.

(56) References Cited

U.S. PATENT DOCUMENTS

| | | | | |
|---|---|---|---|---|
| 4,150,262 A * | 4/1979 | Ono | H04M 1/62 | 381/190 |
| 4,195,360 A * | 3/1980 | Fothergill | G01S 3/8083 | 367/136 |
| 7,903,826 B2 * | 3/2011 | Boersma | H04M 1/6058 | 381/57 |
| 2001/0024507 A1 * | 9/2001 | Boesen | H04M 1/6066 | 381/315 |
| 2010/0030562 A1 * | 2/2010 | Yoshizawa | G10L 21/0208 | 704/270 |
| 2012/0215519 A1 * | 8/2012 | Park | G06F 17/289 | 704/2 |
| 2014/0044269 A1 * | 2/2014 | Anderson | H04R 5/04 | 381/57 |

FOREIGN PATENT DOCUMENTS

| | | |
|---|---|---|
| JP | 2009-529275 A | 8/2009 |
| WO | 2007-102047 A1 | 9/2007 |

* cited by examiner

*Primary Examiner* — Sunita Joshi
(74) *Attorney, Agent, or Firm* — Procopio Cory Hargreaves and Savitch LLP

(57) ABSTRACT

A portable terminal and a portable terminal system that allows a user to hear an ambient sound highly necessary for the user while wearing an earphone on his/her ear are provided. An ambient sound output determination module is configured to determine whether or not an ambient sound should be output to the earphone based on a sound signal received from at least one microphone of a first microphone and a second microphone. A sound output control module is configured to output the sound signal received from the at least one microphone to the earphone if it is determined that the ambient sound should be output to the earphone.

4 Claims, 9 Drawing Sheets

PORTABLE TERMINAL AND PORTABLE TERMINAL SYSTEM

CROSS-REFERENCE TO RELATED APPLICATION

The present application claims priority under 35 U.S.C. §119 to Japanese Patent Application No. 2014-090366, filed on Apr. 24, 2014, entitled "Portable Terminal and Portable Terminal System." The content of which is incorporated by reference herein in its entirety.

FIELD

The present disclosure relates to a portable terminal and a portable terminal system, and more particularly to a portable terminal and a portable terminal system having a function of outputting sound to an earphone.

BACKGROUND

There is a conventionally known technique in which a user can hear an ambient sound when an earphone is connected to a portable terminal.

SUMMARY

A portable terminal according to one embodiment includes one or more microphones, a determination module configured to determine whether or not an ambient sound should be output to an earphone based on a sound signal received from at least one microphone among the one or more microphones, and a sound output control module configured to output the sound signal received from the at least one microphone to the earphone if it is determined that the ambient sound should be output to the earphone.

The foregoing and other objects, features, aspects and advantages of the present disclosure will become more apparent from the following detailed description of the present disclosure when taken in conjunction with the accompanying drawings.

DETAILED DESCRIPTION

Hereinafter, embodiments will be described with reference to the drawings.

Ambient sounds for a portable terminal include sounds necessary for a user (e.g., the voice of another person talking to the user, a horn sound of a vehicle, and a siren sound of an emergency vehicle) and sounds unnecessary for a user (e.g., noise and a conversation between other persons). Conventionally, when a headset is connected to a portable terminal, ambient sounds may always be output to an earphone, whether they are necessary for a user or not. A system for solving such a problem will be disclosed.

First Embodiment

Figure 1:
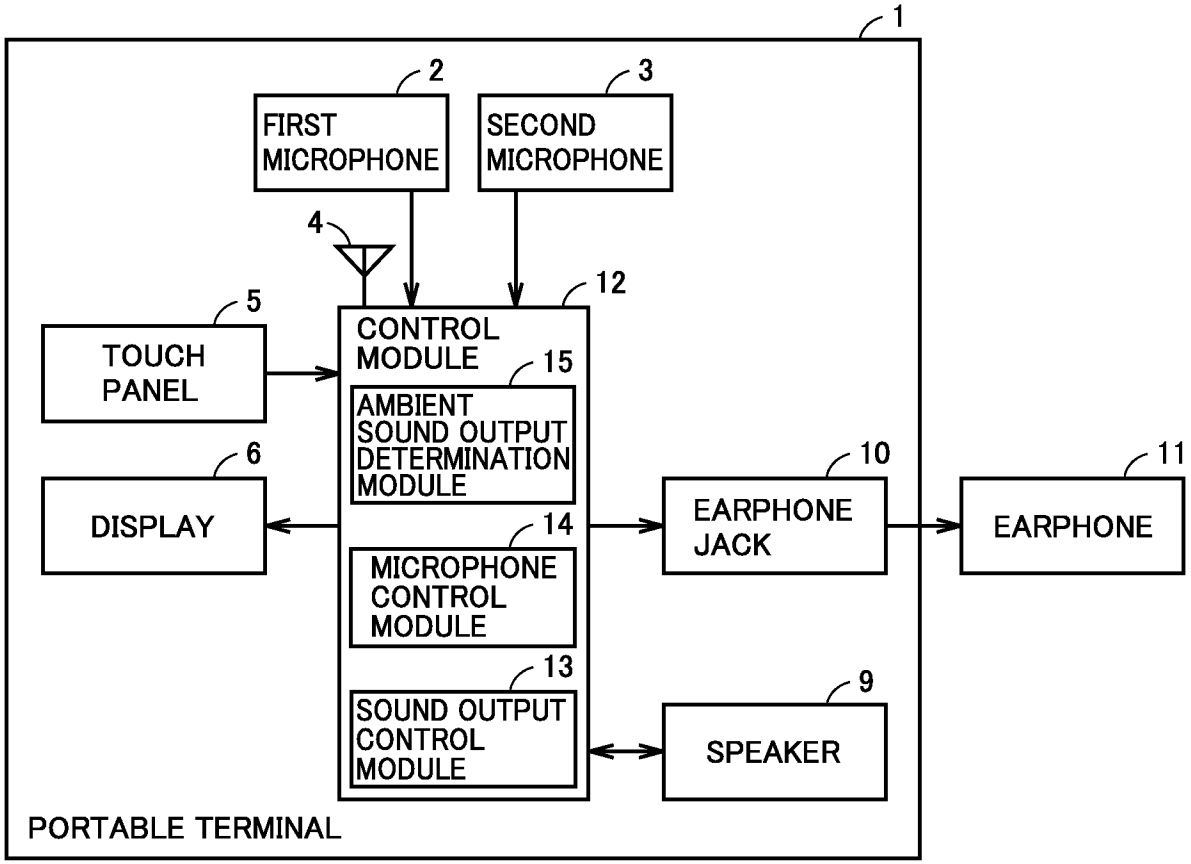
FIG. 1 is a diagram representing a configuration of a portable terminal according to an embodiment.
Figure 2:
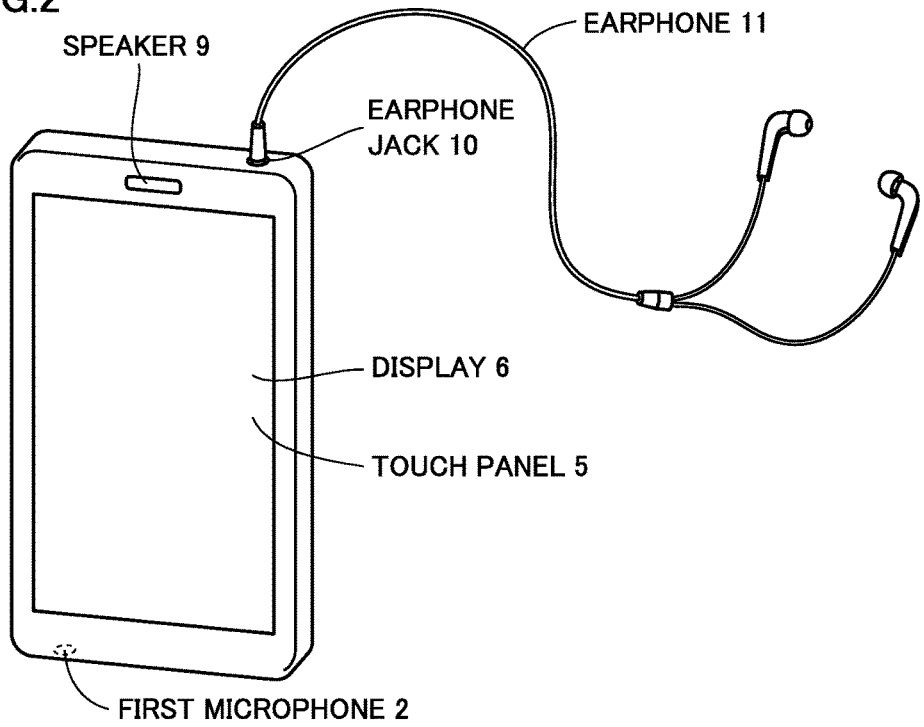
FIG. 2 is a diagram representing an appearance of the portable terminal.
Figure 3:
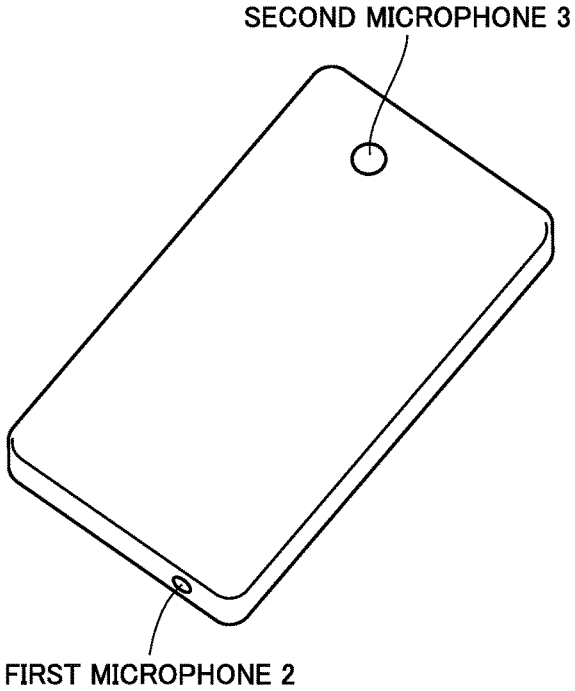
FIG. 3 is a diagram representing an appearance of the portable terminal.

FIG. 1 is a diagram representing a configuration of a portable terminal according to an embodiment. FIGS. 2 and 3 are diagrams each representing an appearance of the portable terminal.

As shown in FIG. 1, this portable terminal 1 includes an antenna 4, a touch panel 5, a display 6, a first microphone 2, a second microphone 3, an earphone jack 10, a speaker 9, and a control module 12.

Control module 12 includes a CPU, a memory module, and the like. By controlling other components of portable terminal 1, control module 12 can manage operations of portable terminal 1 as a whole. Control module 12 includes a microphone control module 14 and a sound output control module 13.

Antenna 4 can be used for wireless communications with a wireless base station.

Touch panel 5 can accept an operation input from a user.

Display 6 can display various types of information such as characters, signs, graphics, and the like.

First microphone 2 and second microphone 3 can convert an ambient sound into a sound signal.

First microphone 2 can be provided in the undersurface of portable terminal 1, as shown in FIGS. 2 and 3.

Second microphone 3 can be provided in the rear surface of portable terminal 1, as shown in FIG. 3.

Earphone jack 10, when connected to earphone 11, can output a sound signal from sound output control module 13 to earphone 11.

Speaker 9 can generate a sound pressure based on the sound signal output from sound output control module 13.

When earphone 11 is connected to earphone jack 10, microphone control module 14 can turn on sound inputs of first microphone 2 and second microphone 3 to receive a sound signal from first microphone 2 and a sound signal from second microphone 3.

Ambient sound output determination module 15 can determine whether or not an ambient sound should be output to earphone 11 based on the sound signal received from at least one of first microphone 2 and second microphone 3.

In the first embodiment, ambient sound output determination module 15 can detect power of the sound signals received from first microphone 2 and second microphone 3, and when the sum of detected power of the sound signals is more than or equal to a threshold value, can determine that an ambient sound should be output to earphone 11.

When earphone 11 is not connected to earphone jack 10, sound output control module 13 can output a sound signal reproduced in portable terminal 1 by an application program or the like to speaker 9.

When earphone 11 is connected to earphone jack 10, if it is not determined by ambient sound output determination module 15 that an ambient sound should be output to earphone 11 and if a sound signal is being reproduced by an application program or the like, sound output control module 13 can output the sound signal reproduced in portable terminal 1 by the application program or the like to earphone 11 through earphone jack 10.

For example, while a user is on the phone, when a call partner is talking and the user is not, the call partner's voice reproduced by a call application can be output to earphone 11.

When earphone 11 is connected to earphone jack 10, if it is determined by ambient sound output determination module 15 that an ambient sound should be output to earphone 11 and if a sound signal is not being reproduced by the application program or the like, sound output control module 13 can output the sound signal received from first microphone 2 to earphone 11 through earphone jack 10.

For example, while a user is on the phone, and if the user is talking and a call partner is not, an ambient sound including the user's voice can be output to earphone 11.

When earphone 11 is connected to earphone jack 10, if it is determined by ambient sound output determination module 15 that an ambient sound should be output to earphone 11 and if a sound signal is being reproduced by the application program or the like, sound output control module 13 can synthesize a sound signal received from first microphone 2 and the sound signal reproduced by the application program or the like for output to earphone 11 through earphone jack 10.

For example, while a user is on the phone, and if a call partner is talking and the user is talking, the call partner's voice reproduced by the call application and an ambient sound including the user's voice can be synthesized and output to earphone 11.

Figure 4:
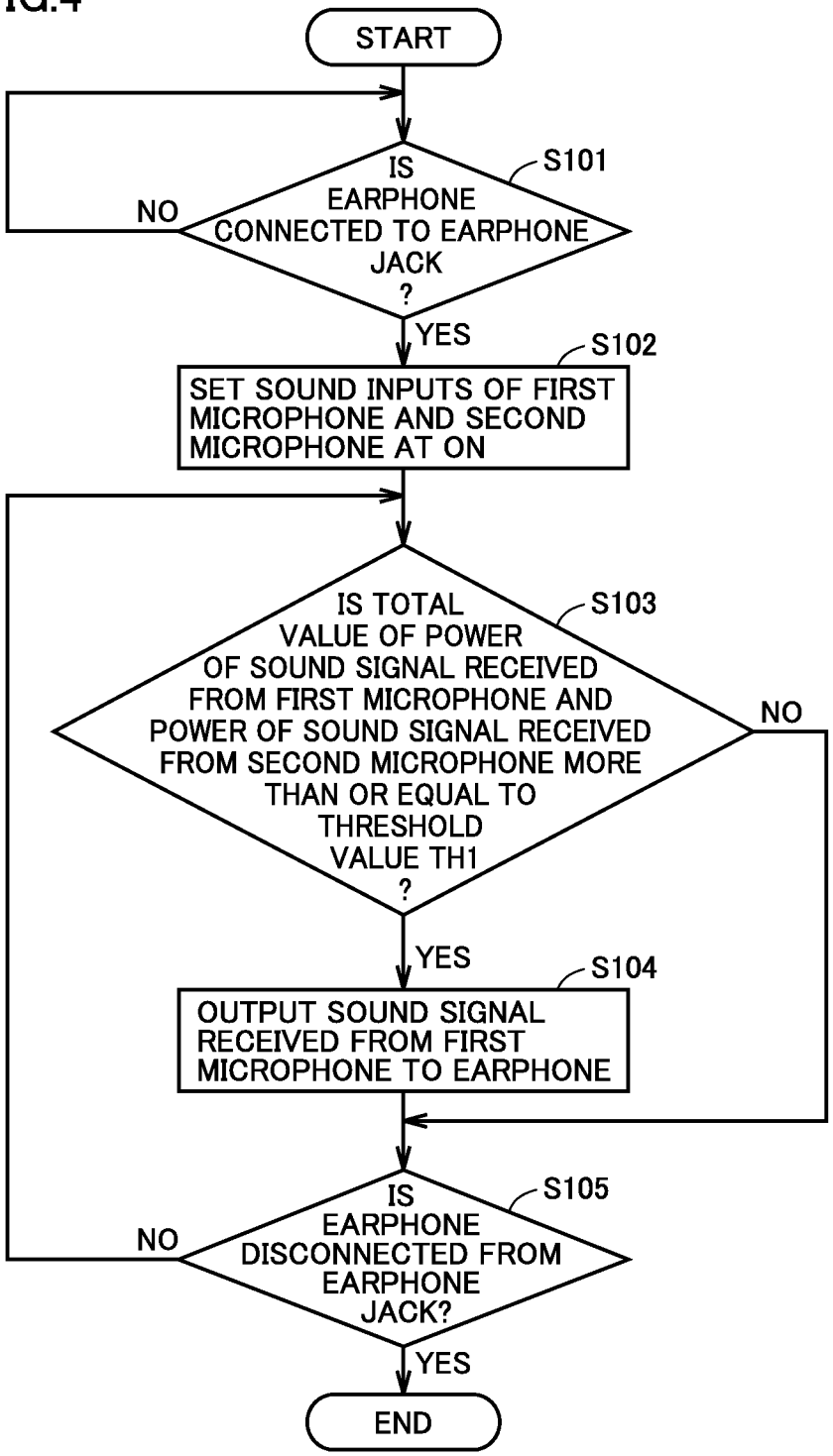
FIG. 4 is a flowchart representing a control procedure for outputting an ambient sound to an earphone by a portable terminal according to a first embodiment.

FIG. 4 is a flowchart representing a control procedure for outputting an ambient sound to an earphone by a portable terminal according to the first embodiment.

In step S101, when earphone 11 is connected to earphone jack 10 (YES in step S101), the process proceeds to step S102.

In step S102, microphone control module 14 can set the sound inputs of first microphone 2 and second microphone 3 at the ON state.

In step S103, if the total value of power of a sound signal received from first microphone 2 and power of a sound signal received from second microphone 3 is more than or equal to a threshold value TH1 (YES in step S103), the process proceeds to step S104.

In step S104, ambient sound output determination module 15 can determine that an ambient sound should be output to earphone 11. Sound output control module 13 can output the sound signal received from first microphone 2 to earphone 11. When a sound signal is being reproduced by an application program or the like, the sound signal received from first microphone 2 and the reproduced sound signal may be synthesized and output to the earphone.

Figure 5:
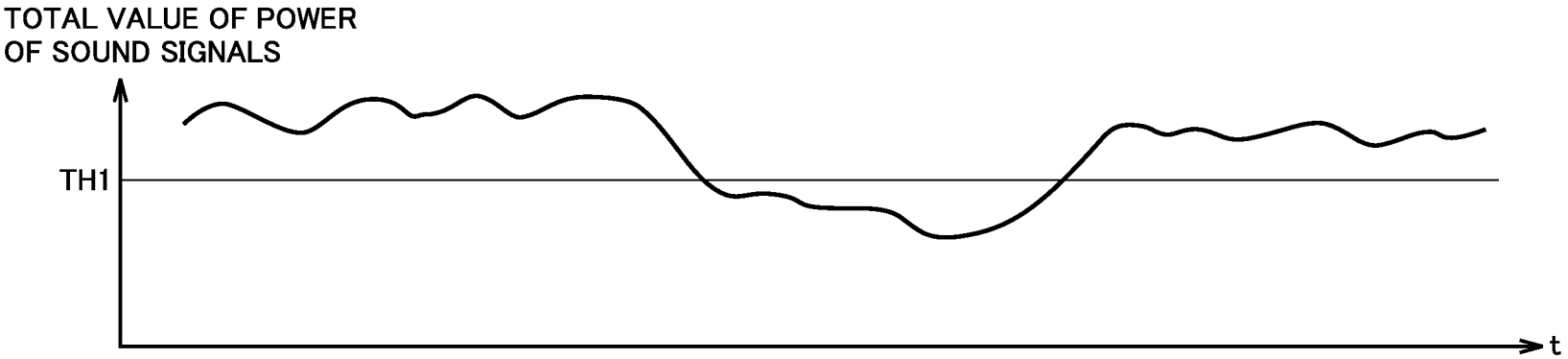
FIG. 5 is a diagram representing an example of a sound signal when outputting an ambient sound in the first embodiment.

Since the sound signal received from the first microphone is output to earphone 11 in a period during which the total value of power of sound signals is more than or equal to threshold value TH1 as shown in FIG. 5, the user can hear, through earphone 11, high-volume sounds around the user, such as the voice of another person different from a call partner and talking to the user, a siren sound of a patrol car, a horn sound of a vehicle, and the like.

In step S105, processing in steps S103 and S104 is repeated until earphone 11 is disconnected from earphone jack 10 (YES in step S105).

In the first embodiment, ambient sound output determination module 15 determines that an ambient sound should be output to earphone 11 if the total value of power of a sound signal received from first microphone 2 and power of a sound signal received from second microphone 3 is more than or equal to threshold value TH1, but this is not a limitation. Ambient sound output determination module 15 may determine that an ambient sound should be output to earphone 11 if power of the sound signal received from first microphone 2 is more than or equal to the threshold value, if power of the sound signal received from second microphone 3 is more than or equal to the threshold value, or if the average value of power of the sound signal received from first microphone 2 and power of the sound signal received from second microphone 3 is more than or equal to the threshold value.

In the first embodiment, the sound signal received from first microphone 2 shall be output to earphone 11 if it is determined that an ambient sound should be output to earphone 11, but the sound signal received from second microphone 3 rather than first microphone 2 may be output to earphone 11. Alternatively, a signal obtained by synthesizing the sound signal received from first microphone 2 and the sound signal received from second microphone 3 may be output to earphone 11. The same applies to embodiments which will be described later.

As described above, according to the first embodiment, a user can hear, through the earphone, an ambient sound highly necessary for the user which is a high-volume ambient sound, such as the voice of another person talking to the user, a siren sound of a patrol car, or a horn sound of a vehicle.

Second Embodiment

Ambient sound output determination module 15 of portable terminal 1 according to a second embodiment is different from that of the first embodiment.

Ambient sound output determination module 15 according to the second embodiment can detect a phase difference between a sound signal received from first microphone 2 and a sound signal received from second microphone 3, and when the detected phase difference is more than or equal to a threshold value, can determine that an ambient sound should be output to earphone 11.

Figure 6:
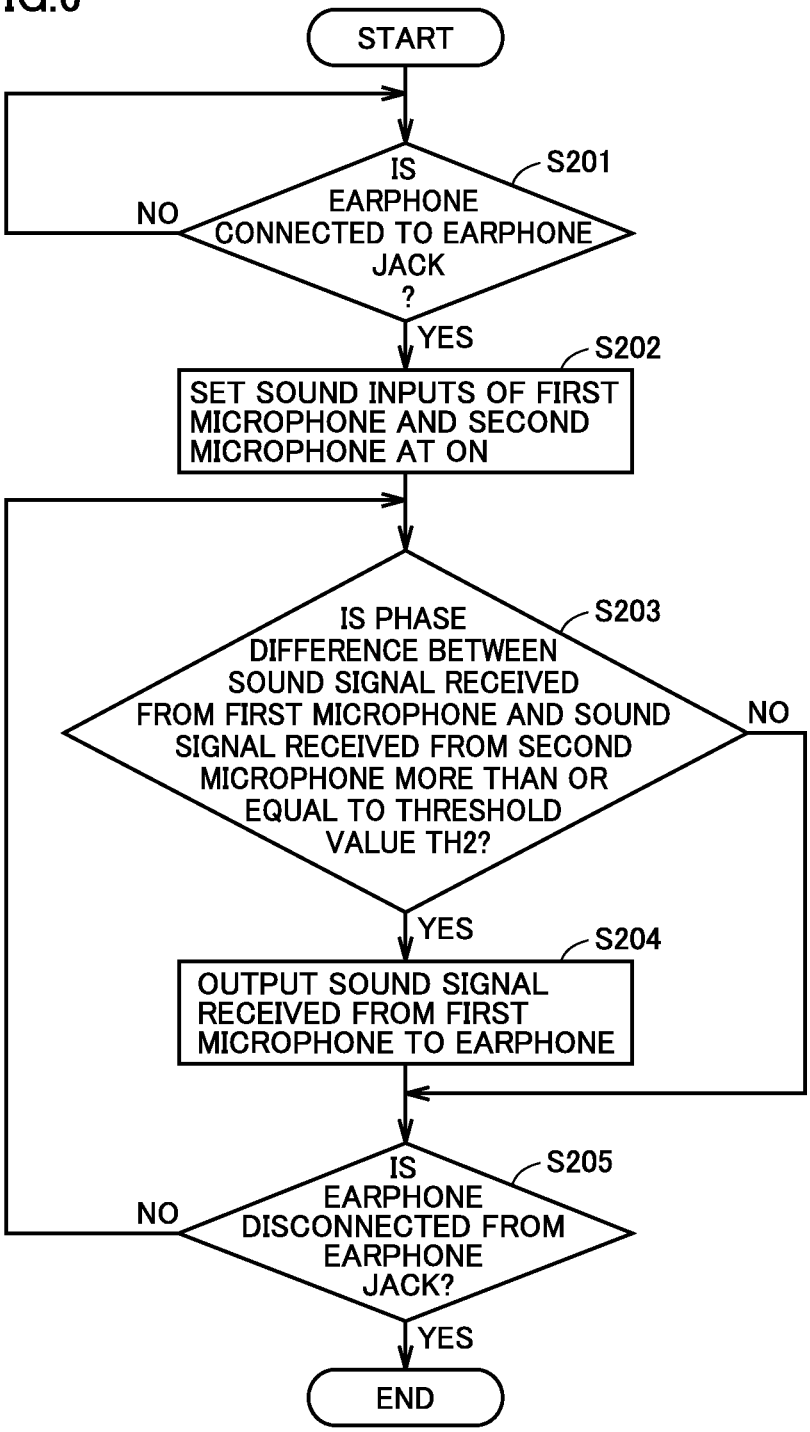
FIG. 6 is a flowchart representing a control procedure for outputting an ambient sound to an earphone by a portable terminal according to a second embodiment.

FIG. 6 is a flowchart representing a control procedure for outputting an ambient sound to an earphone by the portable terminal according to the second embodiment.

In step S201, when earphone 11 is connected to earphone jack 10 (YES in step S201), the process proceeds to step S202.

In step S202, microphone control module 14 can set the sound inputs of first microphone 2 and second microphone 3 at the ON state.

In step S203, if the phase difference between a sound signal received from first microphone 2 and a sound signal received from second microphone 3 is more than or equal to a threshold value TH2 (YES in step S203), the process proceeds to step S204.

In step S204, ambient sound output determination module 15 can determine that an ambient sound should be output to earphone 11. Sound output control module 13 can output the sound signal received from first microphone 2 to earphone 11. When a sound signal is being reproduced by an application program or the like, the sound signal received from first microphone 2 and the reproduced sound signal may be synthesized and output to the earphone.

Figure 7:
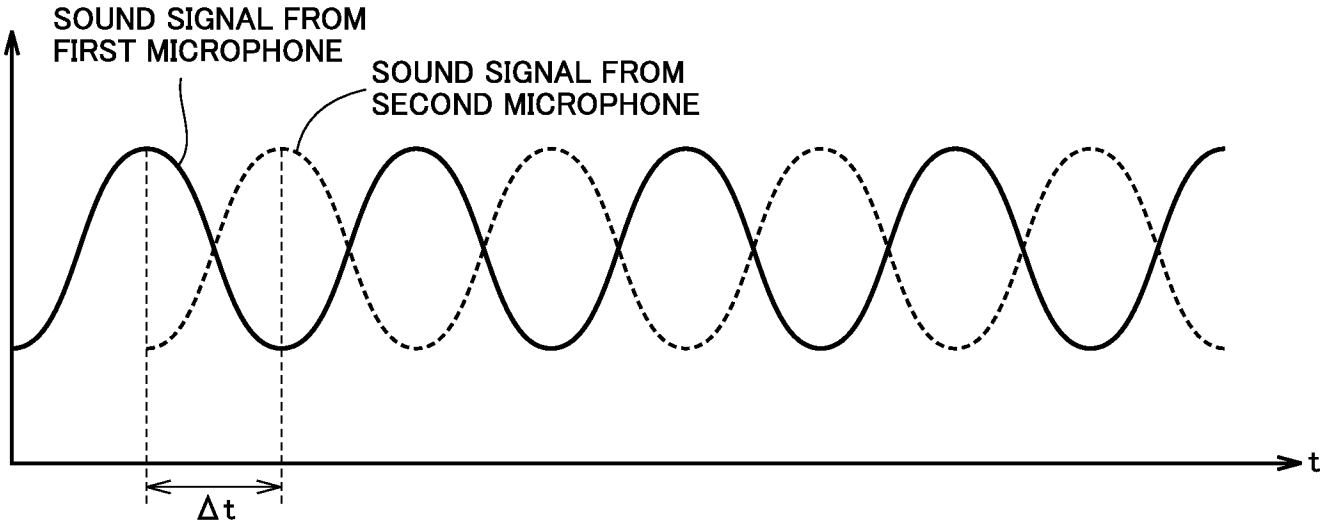
FIG. 7 is a diagram representing an example of a sound signal when outputting an ambient sound in the second embodiment.

As shown in FIG. 7, the phase difference between the sound signal received from first microphone 2 and the sound signal received from second microphone 3 is detected. This phase difference can be detected as a difference Δt between a peak time of the sound signal received from first microphone 2 and a peak time of the sound signal received from second microphone 3, for example. It can be said that, as Δt is larger, the moving speed of a neighboring sound source is higher. Since the sound signal received from the first microphone is output to earphone 11 in a period during which Δt is more than or equal to threshold values TH2, a user can hear, through earphone 11, a sound of a sound source moving at high speeds around the user, such as a siren sound of a patrol car or a horn sound of a vehicle.

In step S205, processing in steps S203 and S204 is repeated until earphone 11 is disconnected from earphone jack 10 (YES in step S205).

As described above, according to the second embodiment, a user can hear, through the earphone, an ambient sound highly necessary for the user which is the sound of a sound source moving at high speeds around the user, such as a siren sound of a patrol car or a horn sound of a vehicle.

Third Embodiment

Ambient sound output determination module 15 of portable terminal 1 according to a third embodiment is different from those of the first and second embodiments.

Ambient sound output determination module 15 according to the third embodiment can determine that an ambient sound should be output to earphone 11 when the instantaneous frequency of a sound signal received from first microphone 2 exhibits a property that decreases with time.

Figure 8:
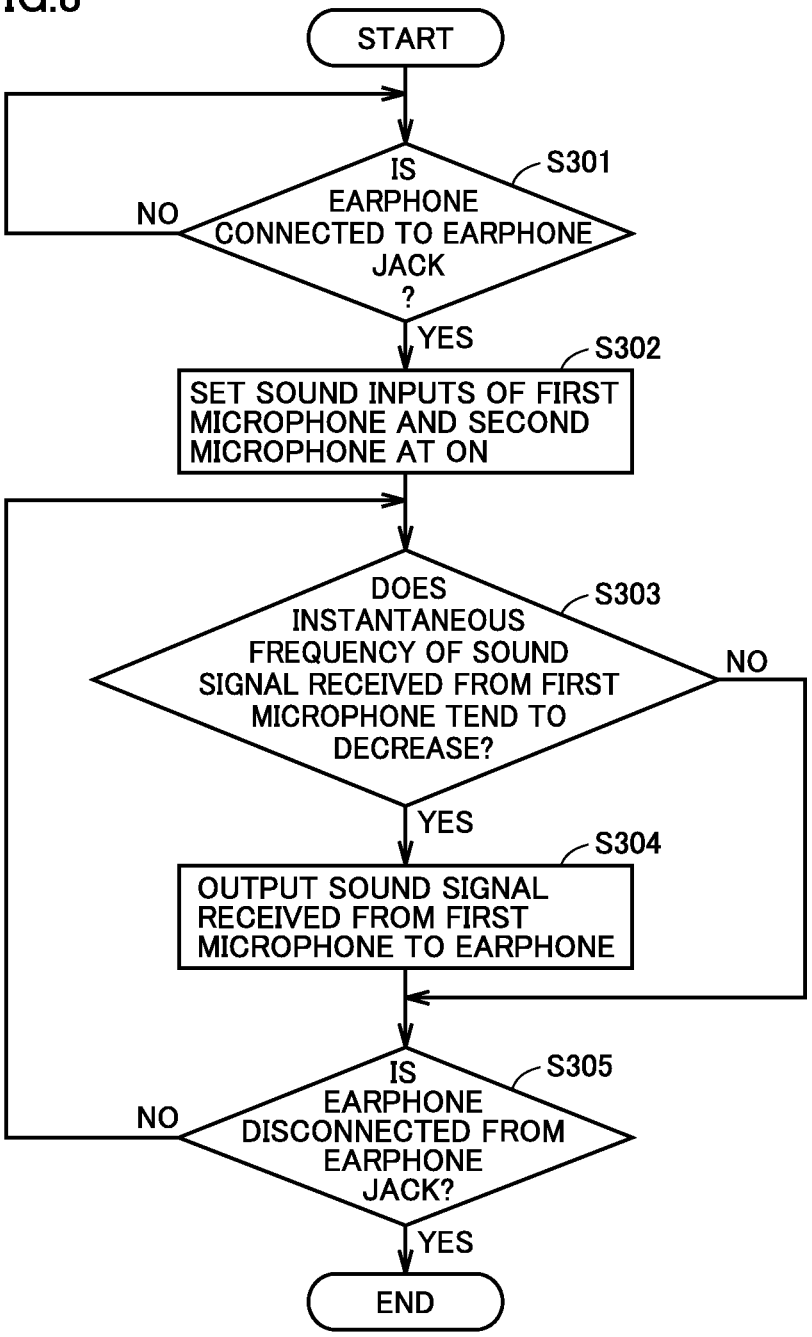
FIG. 8 is a flowchart representing a control procedure for outputting an ambient sound to an earphone by a portable terminal according to a third embodiment.

FIG. 8 is a flowchart representing a control procedure for outputting an ambient sound to an earphone by the portable terminal according to the third embodiment.

In step S301, when earphone 11 is connected to earphone jack 10 (YES in step S301), the process proceeds to step S302.

In step S302, microphone control module 14 can set the sound inputs of first microphone 2 and second microphone 3 at the ON state.

In step S303, when the instantaneous frequency of a sound signal received from first microphone 2 exhibits a property that decreases with time (YES in step S303), the process proceeds to step S304. For example, ambient sound output determination module 15 can determine that the instantaneous frequency of a sound signal has a property that decreases with time when the instantaneous frequency decreases continuously in consecutive three periods. When the instantaneous frequency decreases, a neighboring sound source is approaching a user.

In step S304, ambient sound output determination module 15 can determine that an ambient sound should be output to earphone 11. Sound output control module 13 can output the sound signal received from first microphone 2 to earphone 11. When a sound signal is being reproduced by an application program or the like, the sound signal received from first microphone 2 and the reproduced sound signal may be synthesized and output to the earphone.

Figure 9:
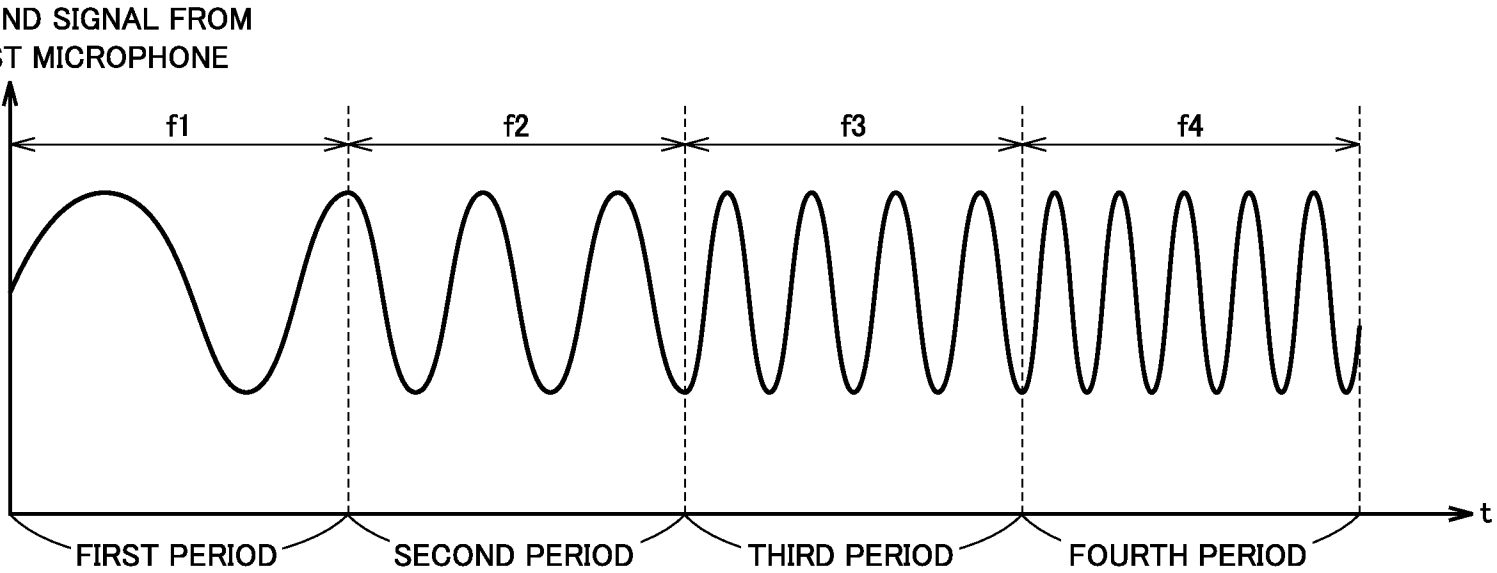
FIG. 9 is a diagram representing an example of a sound signal when outputting an ambient sound in the third embodiment.

As shown in FIG. 9, the instantaneous frequency of the sound signal received from first microphone 2 is f1, f2, f3, and f4 in first, second, third, and fourth periods, respectively, where f1>f2>f3>f4 holds. Since the instantaneous frequency decreases continuously in consecutive three periods, the sound signal received from the first microphone is output to earphone 11. The user can thus hear, through earphone 11, the sound of a sound source approaching him/her, such as a siren sound of a patrol car or a horn sound of a vehicle.

In step S305, processing in steps S303 and S304 is repeated until earphone 11 is disconnected from earphone jack 10 (YES in step S305).

As described above, according to the third embodiment, a user can hear, through the earphone, an ambient sound highly necessary for the user which is the sound of a sound source approaching him/her, such as a siren sound of a patrol car or a horn sound of a vehicle.

In the third embodiment, the ambient sound output determination module detects the instantaneous frequency of the sound signal received from the first microphone, and determines that an ambient sound should be output to earphone 11 when the detected instantaneous frequency has a property that decreases with time, but this is not a limitation. For example, a sound signal received from the second microphone may be used instead of a sound signal received from the first microphone. Alternatively, the ambient sound output determination module may determine that an ambient sound should be output to earphone 11 if the instantaneous frequency of a sound signal received from the first microphone exhibits a property that decreases with time and the instantaneous frequency of a sound signal received from the second microphone exhibits a property that decreases with time.

Fourth Embodiment

Figure 10:
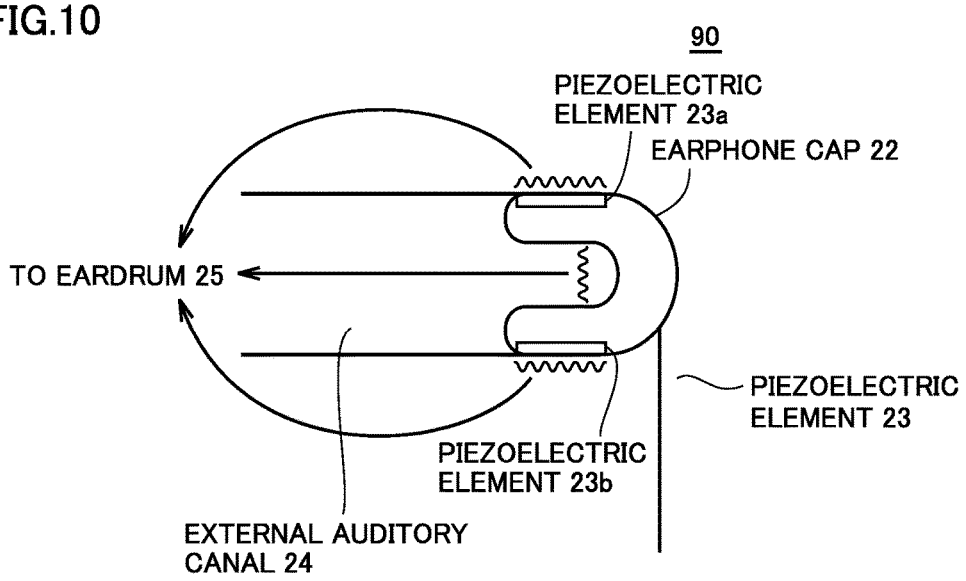
FIG. 10 is a diagram representing an appearance of an earphone according to a fourth embodiment.

FIG. 10 is a diagram representing an appearance of an earphone according to a fourth embodiment.

This earphone 90 includes an earphone cap 22. Piezoelectric elements 23*a* and 23*b* are incorporated in earphone cap 22.

A user can wear the earphone on his/her ear such that piezoelectric elements 23*a* and 23*b* in earphone cap 22 are in contact with the skin of an external auditory canal. A portion close to the entrance of an external auditory canal 24 is surrounded by cartilages. A portion of external auditory canal 24 closer to the eardrum is surrounded by bones.

Sound output control module 13 of portable terminal 1 according to any of the first to third embodiments can output a sound signal to piezoelectric element 23.

When piezoelectric elements 23*a* and 23*b* vibrate based on a sound signal output from sound output control module 13, an air-conducted sound can be supplied to an eardrum 25 through external auditory canal 24, and a vibration sound can be supplied to eardrum 25 through a bone portion or a cartilaginous portion around external auditory canal 24.

Fifth Embodiment

Figure 11:
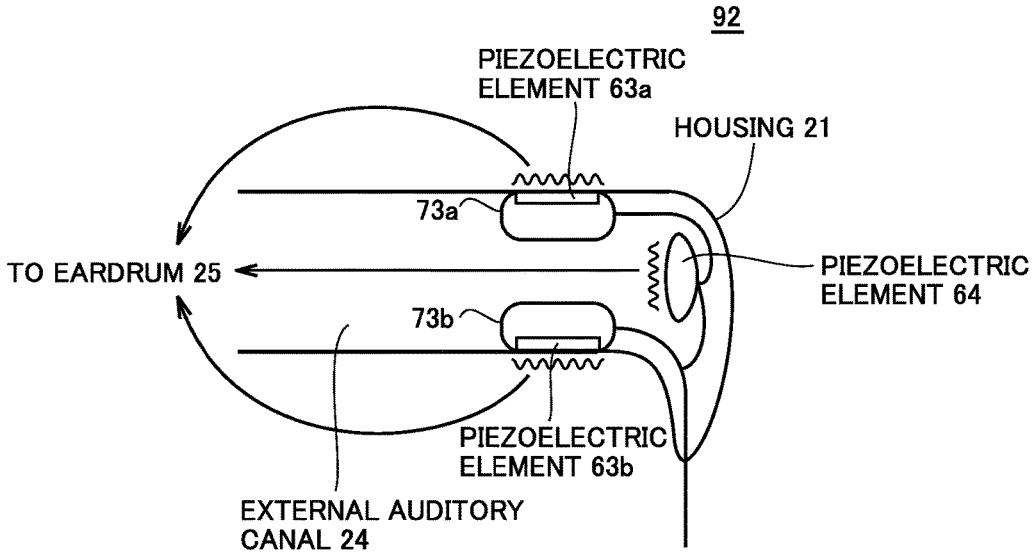
FIG. 11 is a diagram representing an appearance of an earphone according to a fifth embodiment.

FIG. 11 is a diagram representing an appearance of an earphone according to a fifth embodiment.

This earphone 92 includes a housing 21 and piezoelectric elements 63*a*, 63*b* and 64 housed in housing 21.

Piezoelectric elements 63*a* and 63*b* can be incorporated in earphone caps 73*a* and 73*b*, respectively, and a user can wear the earphone on his/her ear such that piezoelectric elements 63*a* and 63*b* are in contact with the skin of external auditory canal 24.

Sound output control module 13 of portable terminal 1 according to any of the first to third embodiments can output a sound signal reproduced by an application of portable terminal 1 or the like to piezoelectric element 64. When piezoelectric element 64 vibrates based on the received sound signal, an air-conducted sound can be supplied by eardrum 25 through external auditory canal 24.

When it has been determined by ambient sound output determination module 15 that an ambient sound should be output to the earphone, sound output control module 13 can output a sound signal received from first microphone 2 to piezoelectric elements 63*a* and 63*b*. When piezoelectric elements 63*a* and 63*b* vibrate based on the received sound signal, a vibration sound can be supplied to eardrum 25 through a bone portion or a cartilaginous portion around external auditory canal 24.

Although embodiments of the present disclosure have been described and illustrated in detail, it is clearly understood that the same is by way of illustration and example only and is not to be taken by way of limitation, the scope of the present disclosure being interpreted by the terms of the appended claims.

The invention claimed is:

1. A portable terminal comprising:

an earphone including a first piezoelectric element configured to vibrate based on a sound signal received from the portable terminal to supply an air-conducted sound to an eardrum through an external auditory canal, and a second piezoelectric element configured to vibrate based on the sound signal received from the portable terminal to supply a vibration sound to the eardrum through a bone portion or a cartilaginous portion around the external auditory canal;

a plurality of microphones;

a determination module configured to determine whether or not an ambient sound should be output to an earphone based on a sound signal received from at least two of the plurality of microphones by detecting a phase difference between at least two sound signals received from the at least two microphones, and determining that the ambient sound should be output to the earphone when the phase difference between the at least two sound signals is more than or equal to a threshold value, thereby indicating that a source of a sound within the at least two sound signals is moving faster than a speed represented by the threshold value; and a sound output control module configured to output a sound signal reproduced in the portable terminal to the first piezoelectric element of the earphone, and to output the sound signal received from the at least one microphone to the second piezoelectric element of the earphone if it is determined that the ambient sound should be output to the earphone.

2. The portable terminal according to claim 1, wherein the sound output control module is configured to synthesize the sound signal received from at least one of the plurality of microphones and the sound signal reproduced in the portable terminal for output to the earphone if it is determined that the ambient sound should be output to the earphone.

3. A portable terminal system comprising an earphone and a portable terminal, the portable terminal including a plurality of microphones, a determination module configured to determine whether or not an ambient sound should be output to the earphone based on a sound signal received from at least two of the plurality of microphones by detecting a phase difference between at least two sound signals received from the at least two microphones, and determining that the ambient sound should be output to the earphone when the phase difference between the at least two sound signals is more than or equal to a threshold value, thereby indicating that a source of a sound within the at least two sound signals is moving faster than a speed represented by the threshold value, and a sound output control module configured to output a sound signal reproduced in the portable terminal to the earphone, and to output the sound signal received from the at least one microphone if it is determined that the ambient sound should be output to the earphone, the earphone including a piezoelectric element configured to vibrate based on the sound signal reproduced in the portable terminal and received from the sound output control module to supply an air-conducted sound to an eardrum through an external auditory canal, and, if it is determined that the ambient sound should be output to the earphone, vibrate based on the sound signal received from the at least one microphone and received from the sound output control module to supply a vibration sound to the eardrum through a bone portion or a cartilaginous portion around the external auditory canal.

4. A portable terminal system comprising an earphone and a portable terminal, the earphone including a first piezoelectric element configured to vibrate based on a sound signal received from the portable terminal to supply an air-conducted sound to an eardrum through an external auditory canal, and a second piezoelectric element configured to vibrate based on the sound signal received from the portable terminal to supply a vibration sound to the eardrum through a bone portion or a cartilaginous portion around the external auditory canal, the portable terminal including a plurality of microphones, a determination module configured to determine whether or not an ambient sound should be output to the earphone based on a sound signal received from at least two of the plurality of microphones by detecting a phase difference between at least two sound signals received from the at least two microphones, and determining that the ambient sound should be output to the earphone when the phase difference between the at least two sound signals is more than or equal to a threshold value, thereby indicating that a source of a sound within the at least two sound signals is moving faster than a speed represented by the threshold value, and a sound output control module configured to output a sound signal reproduced in the portable terminal to the first piezoelectric element, and to output the sound signal received from the at least one microphone to the second piezoelectric element if it is determined that the ambient sound should be output to the earphone.

* * * * *